United States Patent [19]

Rassias et al.

[11] 4,319,440

[45] Mar. 16, 1982

[54] BUILDING BLOCKS, WALL STRUCTURES MADE THEREFROM AND METHODS OF MAKING THE SAME

[76] Inventors: John N. Rassias, 305 E. 86th St., New York, N.Y. 10028; Cecily M. Clark, 565 Park Ave., New York, N.Y. 10021

[21] Appl. No.: 83,764

[22] Filed: Oct. 11, 1979

[51] Int. Cl.[3] ..... E04C 2/04

[52] U.S. Cl. ..... 52/438; 52/605; 52/607

[58] Field of Search ..... 52/438, 437, 436, 605, 52/607, 606

[56] References Cited

U.S. PATENT DOCUMENTS

| | | | |
|---|---|---|---|
| 803,380 | 10/1905 | Wickre | 52/437 |
| 1,171,191 | 2/1916 | Gronert | 52/606 |
| 1,336,025 | 4/1920 | Cook | 52/607 |
| 1,351,471 | 8/1920 | Drabers | 52/436 |
| 1,588,332 | 6/1926 | Peters | 52/436 |
| 2,106,177 | 1/1938 | Hultquist | 52/438 |

FOREIGN PATENT DOCUMENTS

| | | | |
|---|---|---|---|
| 2239969 | 2/1974 | Fed. Rep. of Germany | 52/606 |
| 58774 | 4/1954 | France | 52/607 |
| 65306 | 2/1956 | France | 52/606 |

*Primary Examiner*—Price C. Faw, Jr.
*Assistant Examiner*—Henry E. Raduazo
*Attorney, Agent, or Firm*—Buell, Blenko, Ziesenheim & Beck

[57] ABSTRACT

A building block and masonry wall constructed therefrom are provided wherein the building block has a pair of spaced opposite generally parallel side walls, spaced top and bottom faces and a pair of end spaces, an intermediate generally centrally extending horizontal groove in said top face, a pair of narrower grooves, one on either side of said centrally extending groove on said top face, an intermediate vertical passage of generally keyhole shape in said block corresponding in width to the widest portion of the central grooves on said top face, a pair of vertical passages on each side of said intermediate vertical passage extending from the top narrower grooves, and at least one vertical recess in each end intermediate the side walls and having a cross section substantially equal to one half of said intermediate vertical passage.

11 Claims, 14 Drawing Figures

BUILDING BLOCKS, WALL STRUCTURES MADE THEREFROM AND METHODS OF MAKING THE SAME

This invention relates to building blocks, wall structures made therefrom and methods of making the same and particularly to a building block and wall which is laid up without mortar in the joints in the manner of a dry wall, and without any surface keys or tongues and grooves and provided with openings capable of receiving metal reinforcing bars in both the vertical and horizontal directions surrounded by grout pumped or poured into said openings to surround the metal reinforcing to form a rigid wall of superior strength and of high insulating quality and free from external mortar joints.

It is known to provide building blocks which are laid up in the manner of a dry wall and which are held in place by an inner network of cement grout poured into interconnecting passages in the block. Typical of such prior art blocks are those provided in Zagray U.S. Pat. Nos. 3,534,518, 2,696,102, 2,811,035, 2,634,602, and 2,749,739, Ivany Pat. 3,968,615, Pearlman Pat. 4,075,808 and Grofcsik Pat. 3,382,632. These patents either do not permit the successful inclusion of continuous reinforcing bars from top to bottom of the wall and from end to end and around corners, and cannot accept vertical and horizontal insulation or conduits for utilities, or they require formed integral interlocking tongues and grooves or both. As a result, the wall built from such blocks is subject to cracking and separation as a result of many factors just as is an unreinforced concrete wall or, where interlocking elements are involved, are expensive to make, store and handle. Repeated attempts have been made to insert reinforcing bars in such walls without success because of the voids which are formed, particularly at the intersection of horizontal and vertical reinforcing bars. All attempts, prior to this invention, to avoid this problem have been unsuccessful. As a result, the system of wall construction exemplified by the Zagray and similar partents has met with very limited success and is not approved in many areas.

We have invented a block and wall system and method of installation which overcomes these problems and makes it possible to install both vertical and horizontal reinforcing metal bars along with concrete or mortar grout without the danger of incorporating impermissible voids in the final grout network, which has been the great problem with prior art structures. As a result, the block and wall of this invention are the first which will pass the structural codes of all areas known to us and yet will provide the necessary insulating factor. In addition, our block are free of interlocking tongues and grooves or other elements which project from the top and bottom surfaces and are thus more readily formed, stored and handled and do not require special equipment for their manufacturing, handling and storage.

The Building Block

It is an object of the invention to facilitate rapid installation, adjustment and alignment of the block by providing uniformly compacted, flat surfaces on top, sides and bottom of each block used in the system of construction. As the invention has no protruding or indented surfaces which mesh into each other, and which require removal at top and lintel courses, the invention provides a true three-dimensional module. The flat contacting surfaces of the invention provide a means of eliminating misalignment caused by malformed, damaged or debris-filled tongue and groove configurations of prior art. The flat contacting surfaces of the invention further provide a means of readily correcting specified dimensions at any point within the structure.

An exemplary embodiment of the intralocking attributes of the invention is incorporated in its serving as a matrix for internal vertical and horizontal channels which serve as conduits for grout or other cementatious materials These grout channels feed into corresponding vertical and horizontal grout channels of surrounding block on all levels.

The invention embodies a substantial longitudinal groove within the center buttress shell passing through its entire length at the top and bottom of the block, both grooves of which interconnect at the end of the block with similarly dimensioned grooves running the entire vertical length of each end of the block.

The invention further provides a vertical channel which intercepts the top and bottom center grooves of buttress shell in the middle of the block.

An object of the invention is to provide conduits for grout or other cementatious material which, when placed into the designated channels will bond surrounding block on either side, top and bottom corresponding block as the grout fills similarly configured and located grooves in the adjacent block on all levels.

The invention provides significantly extended center and end vertical grooves which have a secondary groove running longitudinally into the main body of the block at the buttress shell. The purpose of this aspect of the invention is to provide an appropriately large venting channel to assure the escape of displaced air during the pumping of the grout into the main portions of the grout channels, thereby providing positive grout fill to all grout channels.

Another aspect of the extensions described above is to allow more area for larger-sized reinforcement rod or piping to be inserted within the vertical channels without creating entrapped air pockets within the channels caused by insufficient filling area within the grout channel when vertical and horizontal reinforcement rod intersect at the top or bottom portions of the block.

Another attribute of the invention is seen in the longitudinally extended vertical grout channels when filled with grout, result in the forming of a grout key joint through and around each block thereby substantially enlarging the vertical and horizontal grout grid thus formed inside the wall. The thus formed grout key joints materially increase the transverse load capabilities of the structure.

The exemplary embodiment of the invention is thus seen as creating a matrix within the block wherein reinforcing rods can be placed during the assembly of the structure both vertically and horizontally without impeding the flow of grout in any direction when it is pumped into the wall at any level. Another attribute of the invention is seen in the creation of a reinforceable grout grid within the wall totally encasing vertical and horizontal reinforcing rod wherever they are situated. At the same time keyed joint grout pillers are formed vertically throughout the wall at selected intervals, e.g., 2 inch intervals.

Another aspect of the invention is provided in the damming abilities of the grout channels which, while assuring full grouting of the vertical and horizontal grout channels, restricts the grout from entering into the multiple horizontal and vertical insulation chambers.

Another advantage of the invention is seen in the secondary longitudinal grooves located on either side of the center groove of the buttress shell of the top portion of the block. The function of these grooves is to increase the volume of the insulation chambers located beneath each groove between the side shells and the buttress shell located throughout the longitudinal center of the block. Significantly, as these grooves extend the full length of the block they additionally provide an excellent raceway network which interconnects between all block both vertically and horizontally.

As the air chambers within the block are ideally suited to serve as insulated compartments, the invention further provides for the installation of electrical boxes, water connections, piping radiant heat tubes and electrical lines within the insulation chambers. Further, the conduit of a utility line or piping can be vertically placed through the chamber to those points where the grooved portion above the chamber at the top of the block continues beyond the limit of the air chamber in a horizontal direction. By utilizing this method, the utility lines can be run from vertical to horizontal mode and continue for any length through the air chamber longitudinal groove as well as move up or down through any connecting subsequent air chamber within the entire wall or similar structure.

The invention is once more seen as a matrix within which multiple combinations exist such as interconnecting vertical and horizontal raceways for utilities, installation of insulation, electrical, gas, water and heating lines can be installed during the assembly of the wall. Further, by inserting reinforcing rod into the air chamber and then filling it solid with grout reinforced pilasters can easily be created within the wall for heavy load structures.

Another attribute of the invention seen is the ability to insulate utilities from grout and steel reinforcing rods.

Another advantage of the thus structured insulation network is to provide structural integrity to the wall when utility fixtures and conduits are installed. As the center buttress shell of the block serves as the vertical and horizontal network for grout and reinforcement rod, the integrity of the insulation chambers is assured by the vertical walls of the buttress shell which contain the grout within its designated network. This invention allows utilities and conduits to be placed within the wall prior to grouting or, alternatively, after the grout is injected into the grout channels. Because of the separation between sets of insulation chambers afforded by the center buttress shell grout dams, the installation of utilities on one side of the block does not affect the integrity of the block in any way. The invention further provides a means of coursing utilities through the structure within the wall on either side of the buttress shell, or both sides simultaneously, without any damage to the wall. In the event that at a later date it is decided to run additional lines through the wall, the invention affords this opportunity as by cutting into one insulation chamber access to the entire network of insulation chambers on that side of the wall, both vertically and horizontally, is readily accessible with a minimum of cutting and without any structural damage to the wall. Additionally, by drilling the exterior shell at the center of the insulation chamber and through the buttress shell at the center of the block, access to the interior and exterior insulation chamber is readily made at one point. The ability to enter both the interior and exterior vertical and horizontal insulation chamber networks at any point in the wall without damage to the wall itself represents a significant embodiment of the invention.

Another advantage of the invention is that the block so configured can be set up dry, without mortar, thereby maximizing the use of unskilled labor. Upon completion of each story, grout, or other cementatious material, is pumped into openings of the top course of block which insures the positive filling of the interconnecting vertical and horizontal channels through and around each block in the structure.

The versatility of the invention allows either staggered or horizontally stacked courses of block so configured to be constructed with equal ease of assembly and structural soundness.

Another advantage of the invention is the versatility in the various methods that can be used in building structures such as walls and similar assemblies with the maximum utilization of semi and unskilled labor. As all surfaces of each block that come into contact with surfaces of above, below and abutting block are planar to each other, the inventiveness of the system allows assembly of the structures dry, for subsequent pumping of grout as above mentioned; or, as an alternative in those instances where the potential for reconfiguring any given wall area is intended, such as connecting doors into future rooms, garages, or window areas, that portion can be laid up and left ungrouted.

Grid Clips

Grid clips of metal or other rigid material represent a further embodiment of the invention. The grid clips are inserted into abutting block insulation chambers as each course of block is set into position. The lower portion of one side of the grid clip fits into the end of one block's insulation chamber while the other side of the bottom portion fits into the end of the abutting block's insulation chamber. A cross piece located at the middle of the grid clip holds the clip securely within the insulation chambers of the block while at the same time the two upper extensions of the grid clip project upward from the block just laid. As the subsequent source of block is laid the projecting portions of the clips fit into the bottom of the block at their insulation chambers. This creates longitudinal and transverse rigidity between courses. At the top course of such a specified groutless area directly below the bond beam course, the grip clips are inserted into the insulation chambers as above however, the top projecting portions are bent down into the insulation chambers so as not to interfere with the installation of the bond beam course. Grout is prevented from vertically filling the prescribed void area by the dammed bond beam invention later described in this writing.

In the above-mentioned area void of grout, the use of one grid clip will tie together two abutting block as well as one subsequent course corresponding block when staggered stack is used or two abutting block as well as two immediately above block when the horizontal stacking method is used.

Another significant advantage of the inventiveness of the grid clip within the system of assembly of the invention is the ability to construct walls and at any point therein leave any portion of the wall ungrouted so that portion can, at any future time, be disassembled in order to provide access into another area. With the loss of only a few block at the top of those courses the entire ungrouted portion of the wall can be disassembled by removing the grid clips and the block secured by them. This method affords a significant advantage as the structural, thermal and accoustic integrity as well as the appearance of the adjoining grouted walls is not violated. A further advantage is that the means of removing the ungrouted block undamaged allows these block to be used for the additional structure being built.

Another significant object of the invention is to provide an intralocking block and system which will be used by skilled labor in those areas where it is customary to employ highly skilled mason. Because of the extremely high rates of interest on construction loans increasing numbers of developers have instructed their architects to design building using prefabricated panels or pour-in-place concrete construction. Although these methods are considerably more expensive per unit of square foot in place when compared to conventional concrete block construction and further lack some of the insulating, accoustic and structural qualities of concrete block, nevertheless the owners are of necessity changing to the prefabricated methods in order to complete their projects as quickly as possible in order to generate cash-flow by earlier occupancy.

The exemplary inventiveness of the system in such as to significantly increase the productivity of all varying skill quotient so that major savings in time and costs can be realized, including the use of highly skilled labor. The object of the invention is to increase the quality and productivity of construction thereby maximizing all labor markets.

Because of major additional embodiments of the invention which will be detailed hereafter, namely, that of in-place bond beam, corner column and pilaster systems, door and window systems, floor and panel systems, the productivity of the skilled mason utilizing the multiple attributes of the invention will realize a significant increase in demand for his labor. The mason of today is the classic example of a skill which has become economically unviable because of limited productivity.

Because of the attributes of the invention and the increased productivity and quality afforded by it, the skilled mason shall become not only more productive in his block work but also in his overall capability to perform multiple functions of construction which heretofore were not within his reach. With the highly increased productivity afforded by the invention, skilled masons can now effectively compete against prefabricated and poured-in-place methods.

Bond Beam, Pilaster and Corner Column System

Another major advantage of the invention is the ability to rapidly construct, without any carpentry or form work whatsoever or the concomitant delays and additional costs in time, labor and materials, an in-place monolithic bond beam, pilaster and corner column system onto which additional storys can be immediately built. As evidenced in the drawings of the invention attached herewith, upon reaching a story level at which the architects of the structure require a bond beam to be constructed, the following procedure is advised. A number of block of the invention representing the linear footage of the perimeter top of the structure onto which the bond beam will be installed, are laid flat on wood boards placed on the ground. Grout or other cementatious material is poured into the insulation chambers only, to a level representing half the volume of the insulation chambers. The block so treated are left to cure for a few hours during which time further work is carried out on the walls to bring them up to the level where the bond beam course will be required.

When that point is reached, the half-filled block are lifted individually onto the wall and placed so that their vertical grout channels are aligned with those of the block beneath them. Either staggered or horizontal stacking can be used. At those points where the architect has determined pilasters are to be installed, block with their insulation chambers empty are placed. Immediately after the placing of this course of block the required horizontal reinforcement rod is placed into the longitudinal channels on the top of the block. Because of another significant attribute of the invention, namely, the omni-directional corner block, right-angled reinforcing rod is positioned over the column portion of the corner block. Immediately after this course of block is finished, the top course of the bond beam is placed using empty block throughout that course. Depending on the requirements of the architects, additional reinforcing rod can be laid into the longitudinal channels of the top course as well.

At this point the vertical reinforcement rod is dropped into specified vertical grout channels where pilasters are to be formed. Additionally, in cases where extremely heavy load pilasters are needed, further reinforcing rod can be placed at this time into the insulation chambers of that column of block that has already received vertical reinforcing rod through its grout channels.

Upon completing the preparation of the top course and insertion of the reinforcing rod, the wall is then pumped with grout or other cementatious material. The grout hose is directed to the opening of the vertical grout channel starting at one end of the wall and progressing as each vertical channel fills. As the grout fills the vertical grout channels it also flows into the interconnecting horizontal grout channels thereby filling all vertical and horizontal grout channels within the structure.

The half-filled insulation chambers of the next to the last course act as dams to prevent grout flowing into the insulation chambers of the multiple courses of block beneath, except however, in those areas where the architect has called for pilasters. As all vertical, and hence horizontal grout channels are filled, the grout operator then fills all the top course, including all insulation chambers. By so doing grout flows through the insulation chambers into those directly beneath and is stopped from further vertical flow by the previously half-filled insulation chambers of the next to the last course.

In those areas where pilasters are designated, as the insulation chambers of the block directly over the area wherein a pilaster is to be cast have not had their insulation chambers half-filled, the grout will flow to the bottom of that portion of the wall lapping reinforcement rod projecting from the footer and thereby interfacing a reinforced structural member from bond beam through the pilaster to the foundation. In order to prevent grout flowing through the horizontal channels of the insulation chambers, corner block are alternately stacked at the pilaster point as well as at the corners with the reinforcing rod vertically passing through the column end of the invention of that block. Another point of invention is the set of horizontal insulation channel dams located within the top portion of the corner block which will contain the grout in a vertical mode.

As the grout thus poured into the wall, bond beam, pilasters and corner columns is securely contained on all sides within the matrix of the loadbearing block itself, the grout is protected from weather changes and thereby can cure in an ideal condition.

As no formwork has been utilized to configure the bond beams, pilasters or corner columns and, as each block within the wall is loadbearing in its own right and, further, as each block is bearing block-to-block thus obviating the need to wait for mortar joints to cure, construction on subsequent courses for the next storys of structure can commence immediately.

A further advantage of the system is the ability to immediately place lapping reinforcement rod vertically for subsequent storys as they are built. As the grout just placed into the bond beam is still plastic, it affords excellent opportunities to install inter-facing vertical reinforcement rod in two ways. The vertical reinforcing rods of the previous story can be left slightly higher than the top of the bond beam course previously formed. The first course of block for the next story is positioned directly over the extensions of the reinforcing rod of the previous story which are projecting from the bond beam. Alternatively, angled reinforcing rod can be inserted into the still plastic grout of the bond beam and block placed over them so that the reinforcing rods project through specified vertical grout channels where pilasters will be formed. When the bond beam cures it provides and excellent interface of reinforcement between storys. These methods obviate the requirement of drilling and placing dowels into the previous story's bond beam, which requires waiting for the bond beam to cure before drilling the dowel holes.

Lintels

Another ramification of the invention is the ability to cast in-place lintels. At those points where it is determined to place doors and windows, door and window frames are braced into position. As the building of the wall reaches the uppermost part of the frames horizontal reinforcing rod is laid into the longitudinal grout channel of the block above and across the frames. The rod is of sufficient length so that portions of it bridge to the grout channel of the abutting block at each end of the frame. The insulation chambers of the block encasing the reinforcing rod are then filled with grout or mortar. When the grout is pumped into the wall at the bond beam level it will fill the vertical and horizontal grout channels of the lintels. This creates a reinforced monolithic lintel and assures perfect bonding to the abutting block.

Of significant importance in the above procedure is the ability to assure perfect height compatibility between the block forming the lintels and those abutting on either side. The invention, having all top and bottom surfaces uniformly flat, obviates the necessity to grind off off-set levels as found in prior art. The off-set levels create height differences at lintel and top courses as previously discussed. Because of these differences module control is difficult to maintain without alteration of lintel and top course levels.

Cornerblock And/Or Half Blocks

Another advantage of the invention is the ability to provide an omni-directional corner block which, when installed and grouted into a wall or similar structure, is capable of structurally functioning as a corner column. The thus formed corner column of the invention, because of the large capacity and unobstructive design of its corner union portion, has the additional significant capacity to receive multiple large diameter reinforcing rod vertically, and horizontally, with an interface of horizontal reinforcing rod at its bond beam level.

Further, owing to the corner blocks omni-directional design and method of assembly it can be used for a left or right corner or in a continuing longitudinal assemblage whereupon the large cavity half of the block can be used as an internal form for a pilaster.

Located on the right, left and end side top portions of the large cavity half of the corner block are indentations containing dams, any of which can easily be tapped out by hammer so as to allow additional horizontal reinforcement rod along the center channel as well as the horizontal insulation channel to turn at a 90 degree angle within the block in right, left or right and left directions simultaneously, as is the case in an intersecting wall, or to continue in a longitudinal direction.

By this invention the use of substantial sections of heavy diameter right-angled reinforcing rod can be placed at corners without butting separate pieces together.

Additional Features of the Invention Are:

1. By simple adjustment of one of the cavities of the mold box of this invention the manufacture of the full length corner block can be changed to the production of 2 half block modules; that is, one half configured as a perfect half of the stretcher block, but also having dams for the horizontal insulation chamber channels at one end, and used accordingly, and the other half now so configured so as to serve as an $8\times8\times8$ pilaster block with the further capacity to also serve as a full-faced end block.

2. As the large cavity pilaster half block has its two sides and one end dammed by knockout top portions, it is ideally suited to serve as an end block in a longitudinal wall as these dams prevent grout leaking out of the wall when it is pumped. Plugging or framing of exposed grout channels at the end of walls is thus avoided thereby significantly saving time and the need for skilled labor and materials.

3. In a wall section an alternative method of creating a pilaster as previously indicated in the bond beam section of this writing is as follows: when the first course of block is placed onto the footer, at those points where a pilaster is required a full corner block is placed. On subsequent courses further corner block are placed so that all large cavity portions of the corner block are vertical to each other. Reinforcing rod is then placed vertically into the top course of the thus formed pilaster and grout is pumped into the bond beam course. As grout fills the bond beam the reinforced pilaster will be thus formed interfacing with the bond beam.

4. At door openings a corner block is placed on the first course against the door frame with the large cavity against the frame. Subsequent courses are then pilaster half block placed directly over the large cavity portion of the corner block directly below, the large cavity portion of the corner block directly above the pilaster half block and so on so as to maintain a staggered stacking if such is being used. If horizontal stacking is being used all courses abutting the door frame will have full corner block stacked upon each other, all with the large cavity portion of the corner block closest to the door frame. Under either methods of stacking courses the large cavity is closest to the frame. When grout is pumped into the top of the wall it will fill the vertical and horizontal grout channels throughout the entire wall and as the corner block has a horizontal channel access at the center of the full corner block, the grout will thereby flow into the large cavity of the corner block thus used to create a significant pilaster support for the door frame which, additionally, automatically ties that pilaster into the lintel above the door frame. This method can also be used for giving additional support and weathersealing around all window frames as well. It is therefore evident that the invention now permits a rapid, inexpensive means of creating pilasters on either side of door and window frames which structurally interconnect with the corresponding lintels above such openings. This method provides additional transverse strength to these usually stress prone areas. This method further provides setting in Michigan type or similar control joints within the vertical grout channels of the abutting block of the thus formed pilasters so as to prevent the common occurrence of random cracking around door and window frames which represents a major structural and maintenance problem of conventional construction.

5. The dams of the horizontal insulation chambers of the regular half block mentioned in #1 above serve to stop grout flow from entering the insulation chambers at any point in the structure when they are used as abutting block to corner block or pilaster block modes. This block is easily converted into a regular half stretcher block with continuing horizontal insulation channels by tapping out the two dams at one end of the block which gives access to those channels for raceways for utilities and or additional interconnecting insulation areas.

6. Because of the versatility of the omni-directional corner block it is ideally suited to be placed into a wall at a perpendicular and thus serve as a reinforceable, both horizontally and vertically, interface for an intersecting partition wall. This invention further creates a major improvement in laterally supporting intersecting walls and greatly increases the transverse load capabilities of both walls without the need for metal anchors, round ties or hardware cloth. This ability of the invention affords considerable savings of time and material while at the same time increases the strength of the entire structure.

7. The large cavity portion of the corner block used as above further allows proper horizontal and vertical lapping and total encasement of the reinforcing rod by a mass of grout within the corner joint so as to assure maximum transverse load capabilities of those key areas of the structure.

8. The corner block of the invention further provides a means of coursing utilities at a 90 degree angle through the corner block itself so that they may continue at a perpendicular from their originating points. This is accomplished by tapping out one of the dams in the large cavity of the corner block which corresponds with the horizontal insulation channel which is conveying the utility conduit and also removing the dam situated at a 90 degree angle to the first dam that is tapped out. The conduit of the utility is then laid into the horizontal insulation channel so that its 90 degree angle is set within the corner cavity and continuing at a perpendicular from its first direction. A small amount of mortar or other cementatious material is then placed over the two areas where the conduit passes over the removed dams. This method serves to reseal the dam areas so that when grout fills the vertical cavity of the corner block, no grout will flow into toward the insulation chamber. Thus installed, the conduit is safely within the grouted area of the corner column. This method greatly improves the installation process of utilities and has the further advantage of protecting the utilities from damage. The method also avoids the practice of hammering into block after the wall is constructed to install utilities which violates the integrity of the structure as well as adding significantly to the requirements of additional labor, time and material in repairing the fractures thus caused by installing the utilities in the conventional manner.

9. By using the invention, the resulting savings are significant for by installing the network of utilities within the wall as the wall is being assembled greatly reduces the requirement for skilled additional labor as well as reducing the requirement for using wallboard and furring strips to support and cover utility lines which are conventionally nailed or otherwise secured to the block shell surfaces.

10. The pilaster half block is ideally suited to act as a vertical conduit for large diameter water and drain pipes within the wall. By leaving its three-sided dammed portion intact, a small amount of mortar or other cementatious material is placed over its top and bottom grout access hole so as to restrict grout from flowing into that block if it required to be left unfilled. This method further allows the pilaster half block to be used for a conduit for ductwork for HVAC purposes.

11. The above designated abilities inherent in the invention to create a network of utility raceways and conduits within the wall as it is being assembled is further extended by the versatility of the invention's ability to continue the networks through the bond beam course at any point so as to readily continue from story to story, as they are being constructed, without the necessity of drilling into finished walls or bond beams to gain access to the utility lines.

12. The assembly of the invention is modular hence the architect is afforded the further advantage of placing auxilliary lines within the wall which can be located readily connected, should additional outlets be required.

13. Of further interest is the ability to install utility conduits within the wall as it is being erected in those areas where the block will be secured by the use of the previously referred to invention of the grid clip. At such time when that portion of a wall secured by grid clips is disassembled for purposes of creating doors, windows or other openings so as to reconfigure the structure, ready access to the utility is thus available without damage to wall or to the utilities situated within that portion of the structure. Redirection of the utilities can then be tied into the additional areas to be built or rerouted over the new openings.

We provide as a basic block, a substantially rectangular building block having a pair of spaced opposite generally parallel sides, spaced top and bottom faces and spaced end faces, a central groove is provided in each of the top and bottom faces and a pair of smaller grooves are provided, one on each side of the central groove in one of the top and bottom faces, preferably the top face, a double keyhole passage is provided vertically intermediate the side and end walls, each end wall is provided with a keyhole groove equal to half the double keyhole passage, each of the passage and groove connecting the top and bottom central grooves, and a pair of vertical passages extending vertically from the smaller grooves to the opposite top or bottom as the case may be. We also provide a corner block in which one end is flat and the other end is grooved precisely as is our basic block. The half of the corner block which is grooved is precisely like one half of our basic block while the other half has a large generally square vertical passage, the walls of which at the top and bottom have recessed portion of reduced wall thickness matching the grooved spacing in our basic block and adapted to have the reduced wall thickness portion readily broken away to form a mating passageway with the basic block grooves. In addition to acting as a corner block, the corner block can be used intermediate the length of a wall to form vertical passages or pilasters. The vertical passage formed at the corner and at intermediate positions are used for passing conduit or pipe and/or filled with grout and vertical reinforcing bars to form solid corner and mid-wall columns or piers. Half block can of course be readily formed in either half of the corner block so as to form half block elements. Preferably the block are fastened together by generally H-shaped grid clamps which enter into the top and bottom passages of superimposed blocks to hold them in place. After a wall has been assembled, grout is placed in the central vertical passages and horizontal grooves to form a central monolithic membrane as will be more fully described hereafter. A significant advantage of the grid clip system is that it permits the assembly of a wall or wall portion, which left ungrouted, can be disassembled in order to provide access into another area. This affords a significant advantage since the structural thermal and acoustic integrity as well as the appearance of the adjoining grouted walls is not violated, moreover, the removed ungrouted block are undamaged and can be reused in any additional structure being built.

The block-to-block method of laying up the block of this invention eliminates the need for exposed mortar joints and thus reduces, if not eliminates, the dependence of construction on weather conditions. Thus, by our practice wall construction can continue in rainy or freezing days, with the block being laid up and then grouted in place under pressure. The grout is protected against the elements by the block shell and by the addition of chemical agents which prevent freezing. High winds, excessive heat, rain and snow are all deterrents to the laying up of conventional mortared block but not to the block of this invention.

In the foregoing general description of this invention, certain objects, purposes and advantages have been set out. Other objects, purposes and advantages will be apparent from a consideration of the following description and the accompanying drawings in which.

Figure 1:
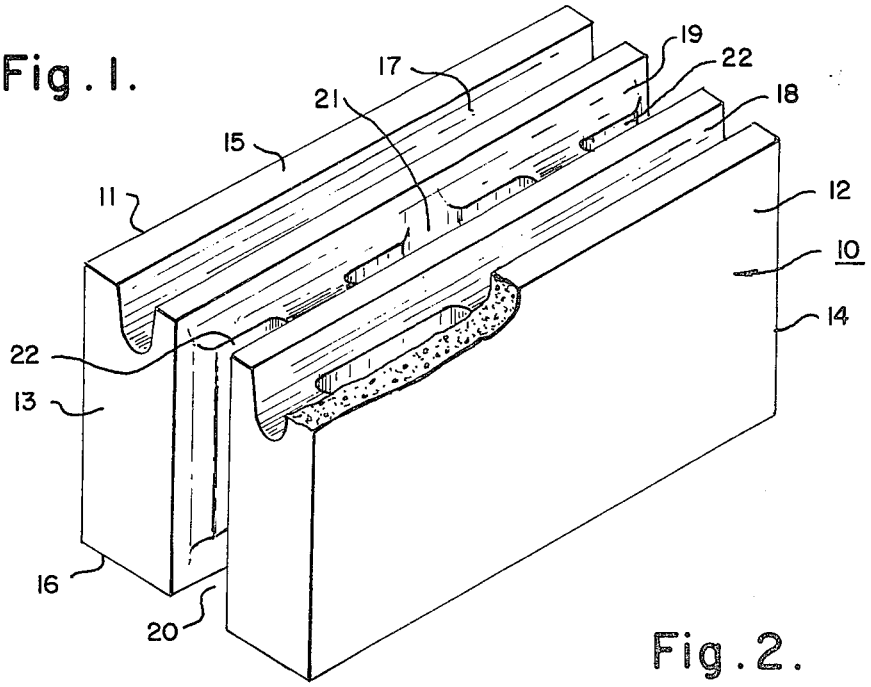
FIG. 1 is an isometric view of a basic block according to this invention.

Referring to the drawings, we have illustrated a block 10 having parallel spaced apart sidewalls 11 and 12, end walls 13 and 14, a top face 15 and a bottom face 16. The top face 15 is provided with a pair of spaced apart generally parallel longitudinal grooves 17 and 18 spaced inwardly from the sidewalls 11 and 12 and with a substantially wider central longitudinal groove 19 intermediate grooves 17 and 18 and spaced from them. The bottom face 16 is provided with a central longitudinal groove 20 which mates with grooves 19 on the top face of the next block below to form a generally ovoid horizontal passage between successive layers of block. A central vertical passage 21 extends between grooves 19 and 20 in the form of a double keyhole passage. A central recess 22 at each end of the block, corresponding in shape to one half of passage 21, extends between grooves 19 and 20 and forms between adjacent end to end blocks a passage substantially identical to passage 21. A pair of vertical passages 23 and 24 extend between grooves 17 and bottom face 16 and a pair of like vertical passages 25 and 26 extend between groove 18 and bottom face 16. Each of passages 23, 24, 25 and 26 extend over about one third of the length of the block and are spaced so that their centers lie intermediate the ends of central passage 21 and end recesses 22 and so that a generally uniform wall thickness is maintained between the passages.

Figure 3:
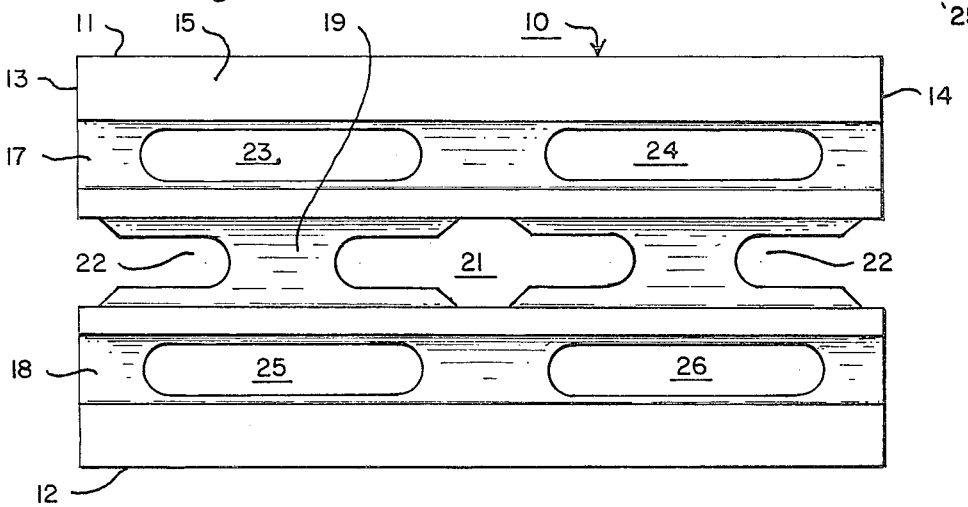
FIG. 3 is a top plan view of the block of FIG. 1.
Figure 4:
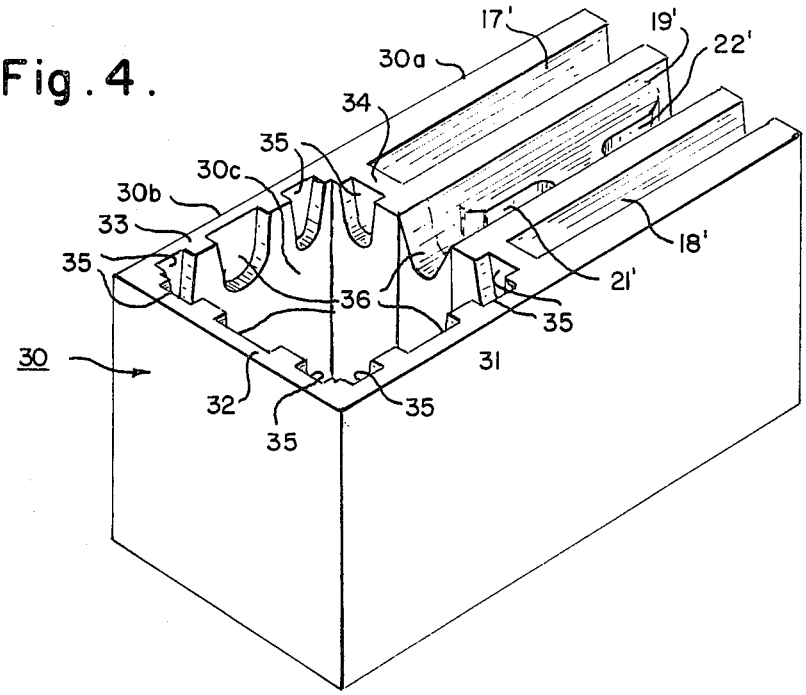
FIG. 4 is an isometric view of a corner block according to this invention.
Figure 5:
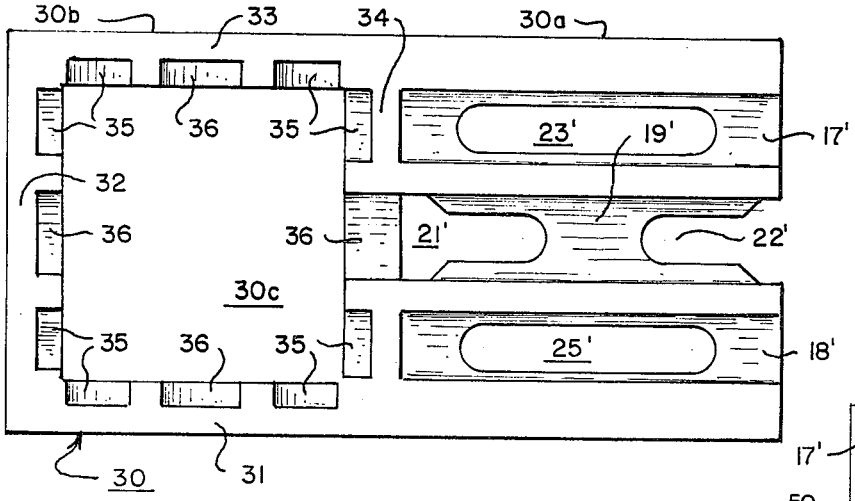
FIG. 5 is a top plan view of the block of FIG. 4.

In FIGS. 4 and 5, we have illustrated a corner block 30 according to this invention. This block has one half **30*a* which corresponds to one half of the block of FIGS. 1 through 3 and like parts are given like numbers with a prime sign. The other half of the block 30*b* has a square vertical passage 30*c* surrounded by generally uniform thickness walls 31, 32, 33 and 34. The upper and lower surfaces of each outer wall 31, 32 and 33, and inner wall 34, are provided with notches 35 and 36 which extend about halfway through the thickness of the wall except in the case of notch 36 in wall 34 which extends through. Notches 35 are as wide and deep as longitudinal grooves 17 and 18 of the main building block. Notches 36 are as wide and deep as central groove 19 on the top face of the main building block. By knocking out the balance of the wall thickness at any group of notches it is possible to place the corner block intermediate the ends of a wall to build a pilaster or to carry a soil or drain pipe or the like, or to use it as a corner running in any direction. Notches 36 are provided on either side of a groove 37 on the wall 34** formed at the middle of the block. The block can be split along this wall to form half blocks of two different types, as is obvious from looking at the block, which will mate with the corner or the main block.

Figure 6:
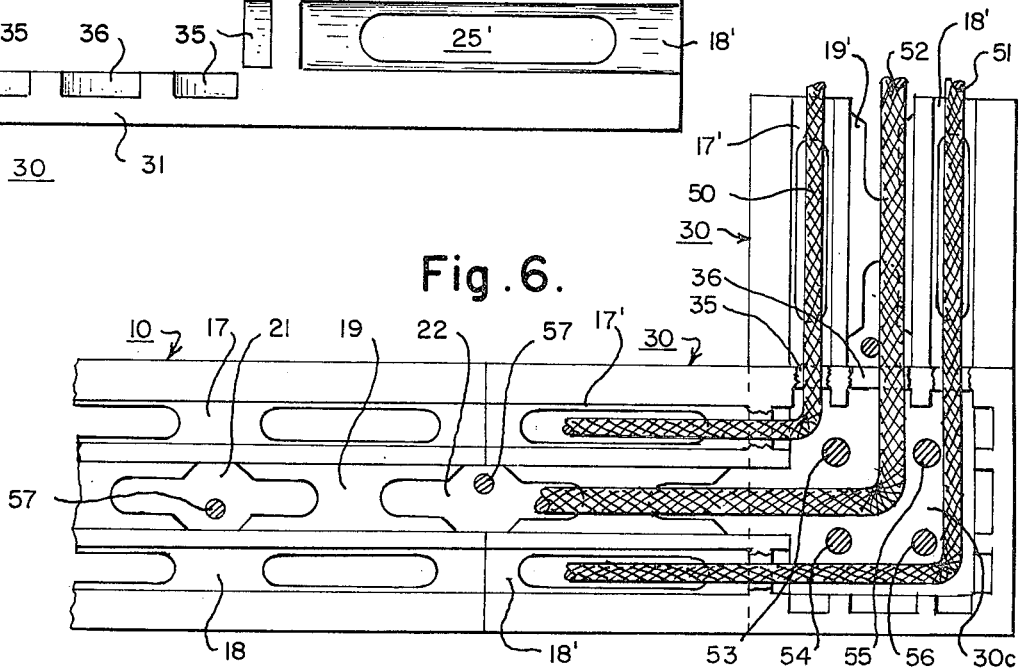
FIG. 6 is a fragmentary plan view of a corner and two adjacent wall segments according to this invention.

In FIG. 6, we have illustrated in plan view the corner of a wall made of blocks according to this invention showing the arrangement of reinforcing rods in the corner block and in the standard block as the wall is laid up. In constructing a wall using the blocks of FIGS. 1 through 5, unskilled labor may be used since no mortar is used in the lay up of the wall. Standard blocks 10 are laid up in successive courses, one on top of another, with staggered joints created by changing the direction of the corner block 30 in each course. Horizontal reinforcing rods 50, 51, 52 are bent at 90 degrees and laid up in the grooves 17', 18' 19' of the corner block after removing the remaining wall at notches 35 and 36 and in grooves 19 of the standard block. Vertical reinforcing rods 53, 54, 55 and 56 are placed in the vertical opening 30*c* of corner block 30. A vertical reinforcing rod 57 is also placed in openings 21 and in the opening formed by adjoining recesses 22. After the wall structure has been completely assembled liquid grout 60 is pumped into vertical passage 30*c*, vertical passage 21 and the vertical passage formed by adjoining recesses 22 under sufficient pressure to cause it to flow horizontally through passages 19 and 19' to form a network of grout and reinforcing rods, within the wall structure so as to bond it together. The grout arrangement is most clearly shown in FIGS. 7, 8 and 9 for various grouting arrangements.

Figure 7:
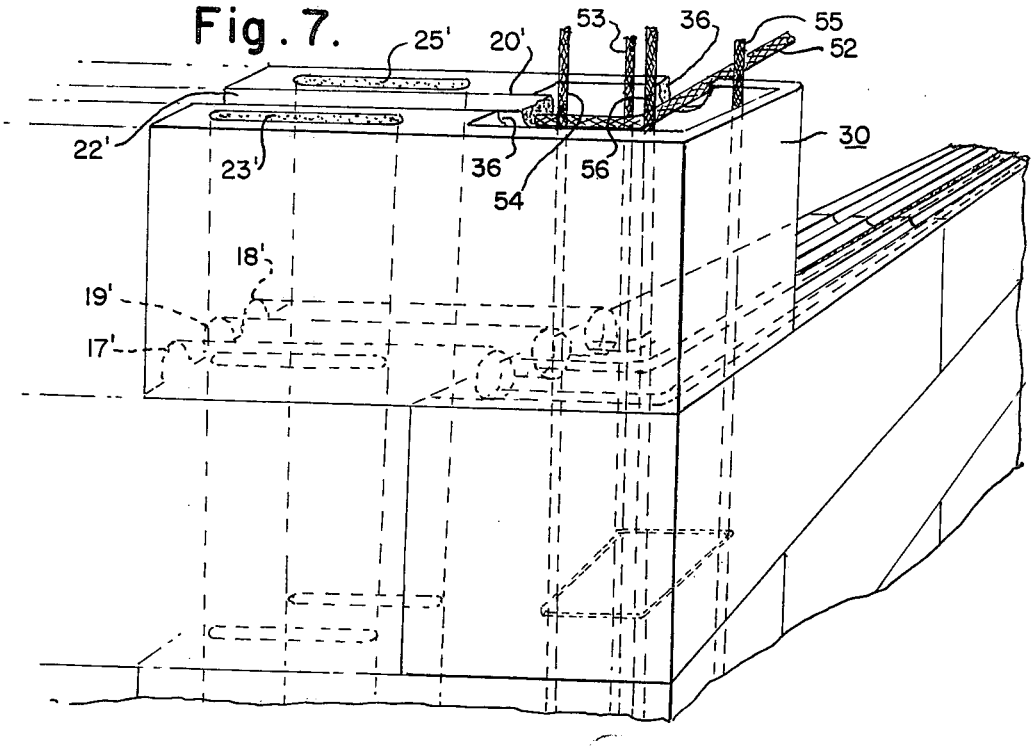
FIG. 7 is a fragmentary isometric view of a corner and adjacent wall segments according to this invention.
Figure 8:
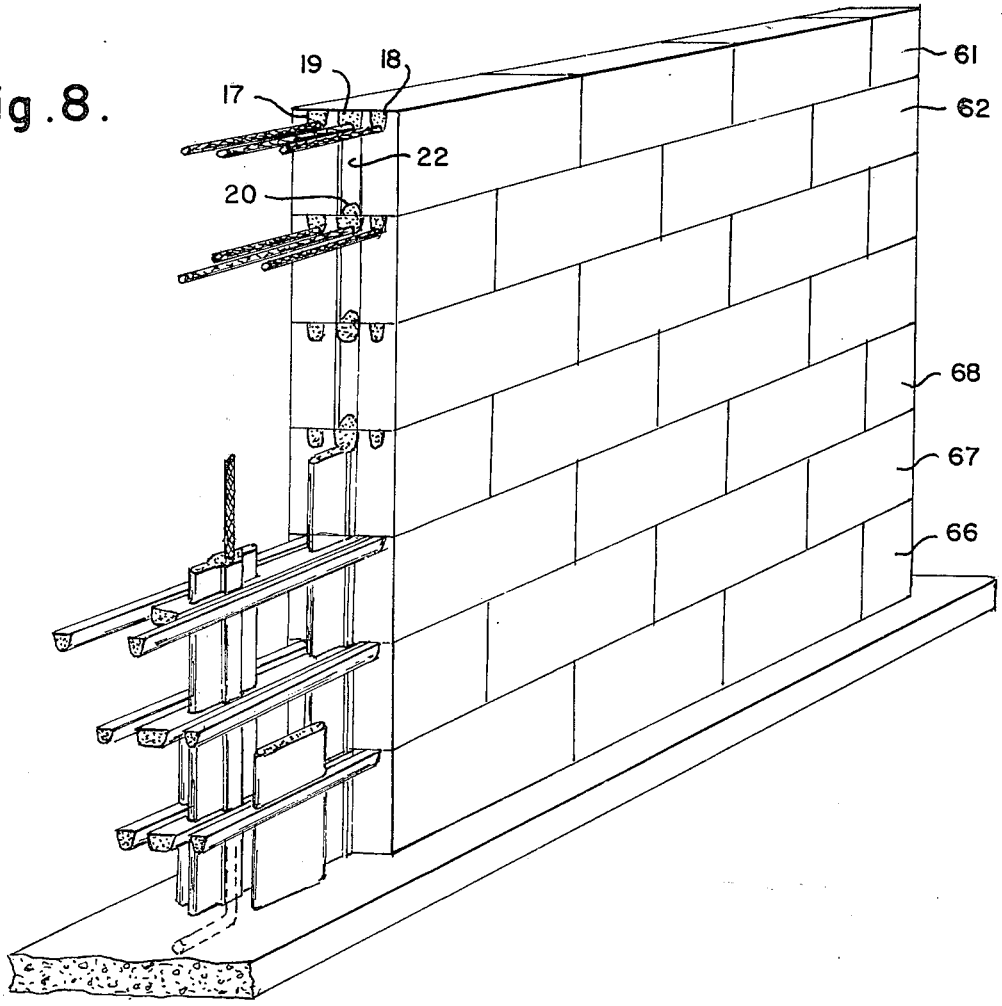
FIG. 8 is an isometric fragmentary view, partly broken away, of a wall according to this invention.
Figure 9:
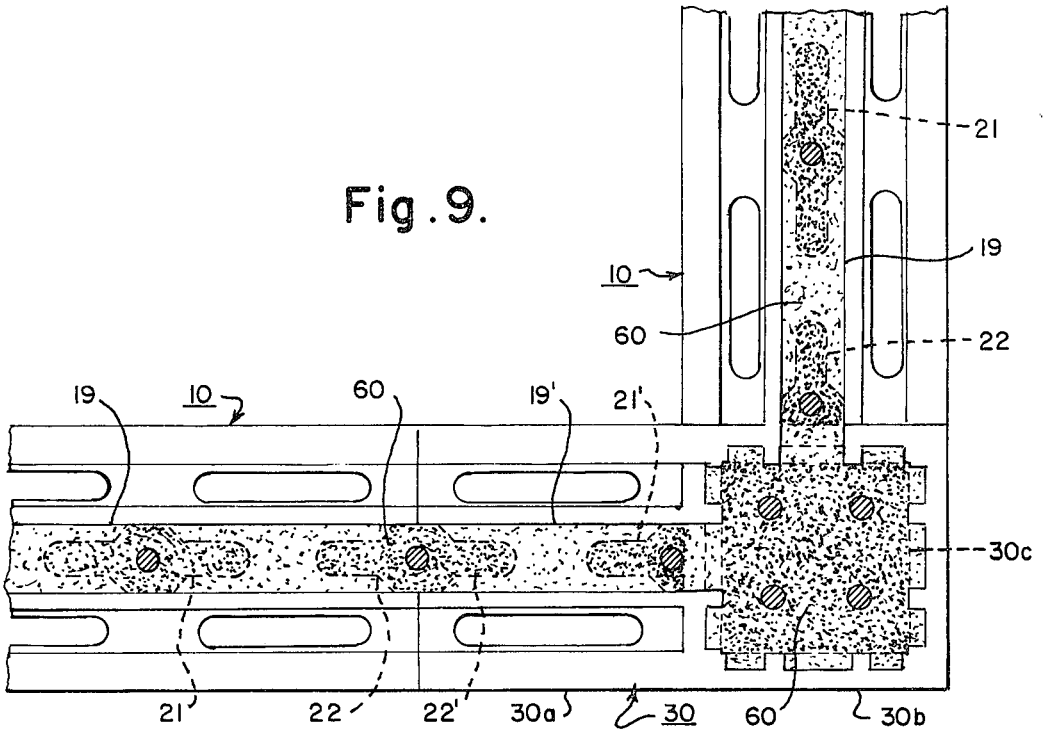
FIG. 9 is a plan view of a corner and two wall segments illustrating the grouting pattern between block layers.

In FIGS. 7 and 8, we have illustrated a preferred practice in which the top two courses of block 61, 62 and bottom course 66 or courses, up to three 67 and 68, are grouted so all of grooves 17, 18 and 19 and vertical passages 22, 23 and 21 are filled with grout to form a substantially monolithich beam. The intermediate courses are grouted with passages 17 and 18 left open to provide insulation.

Figure 10:
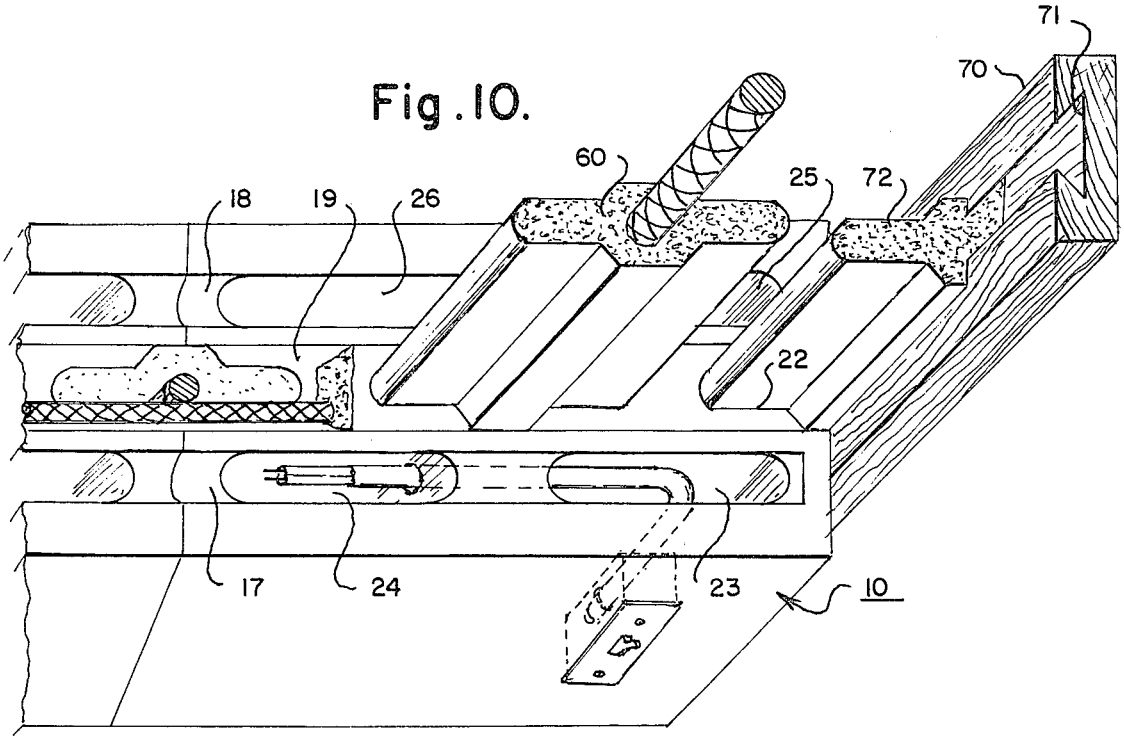
FIG. 10 is a fragmentary isometric view looking downwardly at a door opening and jamb in a wall according to this invention.

In FIG. 10, we have also ilustrated a preferred practice for the installation of door jambs and window frames as an integral part of the structure. The door jamb or window frame 70 is provided with a dovetail groove 71 which is installed in alignment with passage 22 in the end of block 10 prior to grouting and is fixed in place by an interlocking dovetail of grout 72 when the wall is grouted.

Figure 11:
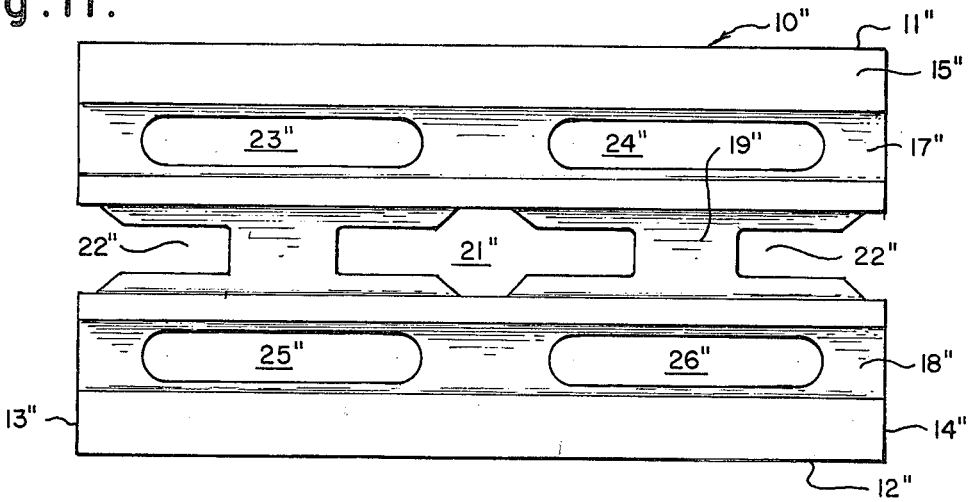
FIG. 11 is a top plan view of a second embodiment of building block according to this invention.

FIG. 11 illustrates a second embodiment of building block according to this invention in which like elements bear like numbers with a double prime sign. The only difference between this block 10" and block 10 is in the shape of vertical passages 21" and 22".

Figure 12:
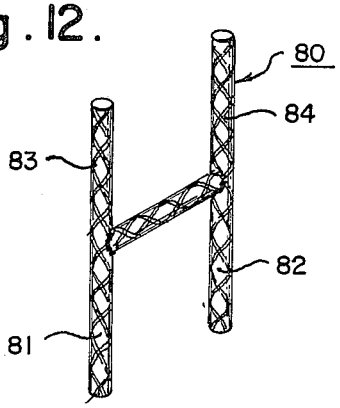
FIG. 12 is an isometric view of a clip according to this invention.

In FIG. 12, we have illustrated a clip 80 which may be used in laying up a wall or portions of a wall which may be subsequently grouted as described above or may be left ungrouted as a temporary wall or wall portion to be removed later. The clip is generally of H-shape configuration with spaced depending legs 81 and 82 adapted to fit in passages 23, 24,25 and 26 of adjacent blocks of one course and upright legs 83 and 84 adapted to fit in like passages of a block in the course above.

Figure 2:
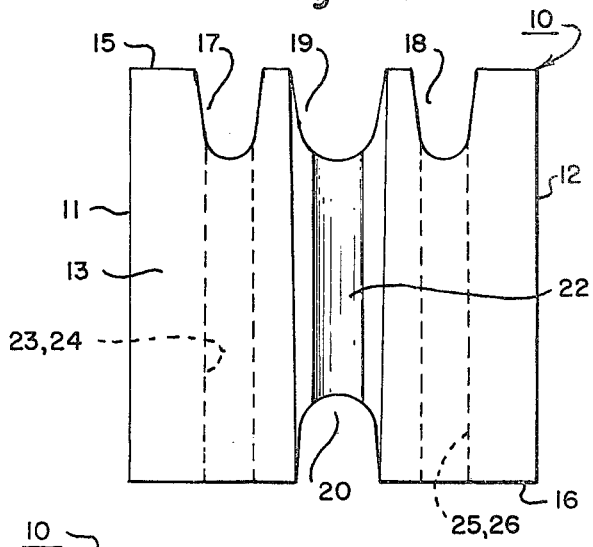
FIG. 2 is an end view of the block of FIG. 1.
Figure 13:
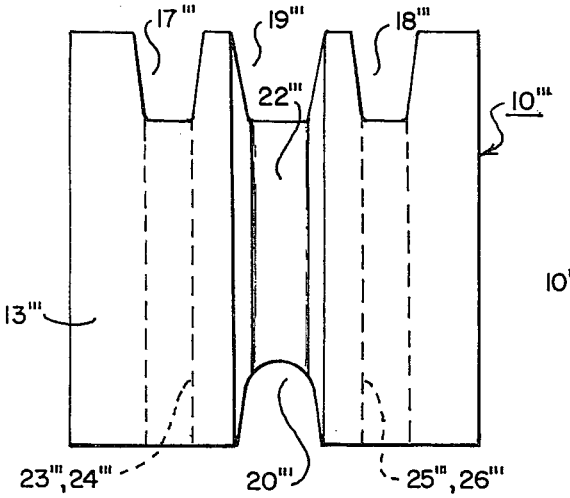
FIG. 13 is an end elevational view of a third embodiment of building block according to this invention.

The embodiment of block illustrated in FIG. 13 is essentially the same as the block of FIGS. 1–3 with like parts bearing like identifying numerals with a triple prime sign. The only difference between the blocks is the shape of grooves 17''', 18''', and 19'''.

Figure 14:
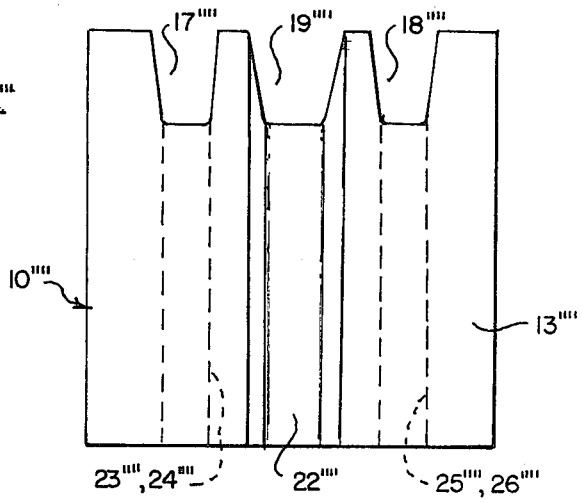
FIG. 14 is an end elevational view of a fourth embodiment of building block according to this invention.

The embodiment of block illustrated in FIG. 14 is essentially the same as that of FIG. 13 with the omission of the bottom groove 20'''.

As shown in dotted line in FIG. 10, grooves 17 and 18 and passages 23, 24, 25 and 26 may be used to carry electrical conduit, plumbing and the like facilities as may also any of the other horizontal and vertical passages 19, 21, 22 and 30*c*.

We are not aware of any prior art building block or masonry wall incorporating the same which provides the unique features of this invention. No other block is so simple in structure and can be laid up into a wall having the strength and rigidity of the block and wall structure of our invention.

In the foregoing specification, we have set out certain preferred practices and embodiments of our invention; however, it will be understood that this invention may be otherwise embodied within the scope of the following claims.

We claim:

1. A substantially rectangular masonry building block having a pair of spaced opposite generally parallel side walls, spaced top and bottom faces and a pair of end faces, an intermediate generally centrally extending horizontal groove in the top face, a pair of narrower horizontally extending grooves, one on either side of said centrally extending groove on said top face, an intermediate generally centrally extending groove in the bottom face on the center line of the groove on the top face, a generally flat land on each side of said intermediate groove in the bottom face adapted to span and overlie the two narrower grooves in the top face of a next subjacent block, an intermediate vertical passage of generally keyhole shape in said block having a central portion corresponding in width over substantially its length to the widest portion of the central grooves on said top and bottom faces, and at least one leg portion extending lengthwise of and narrower than said grooves, said vertical passage connecting said central grooves, at least one generally elongate rectangular rounded end vertical passages on each side of said intermediate keyhole vertical passage extending from the top narrower grooves to the bottom face and offset longitudinally for said central passage and a vertical recess in at least one end intermediate the side walls connecting said central grooves and having a cross section substantially equal to one half of said intermediate vertical passage.

2. A building block as claimed in claim 1 wherein the intermediate vertical passage is a double keyhole shape having a central opening and two opposed legs and extends lengthwise of said block about 25% to 35% of the length thereof and about 25% to 35% the width of said block at the widest point of said passages.

3. A building block as claimed in claim 2 wherein each of the pair of vertical passages on each side of the central vertical passage extends lengthwise of said block about 25% to 35% of the block and about 15% to 25% of the width of said block at the widest point of said passages.

4. A building block as claimed in claim 2 wherein said length and width of the intermediate passage are about one-third of the corresponding dimension of said block.

5. A building block as claimed in claim 3 wherein the length of each of said pair of vertical passages is about one-third of the length of the block and the width of each at its widest point is about 20% of the width of the block.

6. A building block as claimed in claims 1 or 2 or 3 or 4 or 5 wherein the cross sectional shape of the intermediate vertical passages at its largest part is hexagonal in shape with generally rectangular tongues extending lengthwise from opposite sides to form a double keyhole shape.

7. A building block as claimed in claims 1 or 2 or 3 or 4 or 5 wherein the cross sectional shape of the vertical passages on each side of said intermediate vertical passage is an elongate oval.

8. A building block as claimed in claims 1 or 2 or 3 or 4 or 5 wherein the cross sectional shape of the intermediate vertical passage is a double keyhole with the largest portion of oval shape.

9. A building block as claimed in claim 1 having one half in the form of a hollow square, the top edges having notches extending short of the outside faces in line with said horizontally extending grooves and dimensioned substantially the same in width and depth forming a line of weakness whereby a portion of the sidewall may be readily removed to form a continuation of said grooves.

10. A masonry wall structure formed of superimposed courses of masonry building blocks, each block having a pair of spaced opposite generally parallel side walls, spaced top and bottom faces and a pair of end spaces, an intermediate generally centrally extending horizontal groove in the top face, a pair of narrower grooves, one on either side of said centrally extending groove on said top face, an intermediate generally centrally extending groove in the bottom face on the center line of the groove on the top face, a generally flat land on each side of said intermediate groove in the bottom face adapted to span and overlie the two narrower grooves in the top face of a next subjacent block, an intermediate vertical passage of generally double keyhole shape in said block having a central portion corresponding in width over substantially its length to the widest portion of the central groove on said top and bottom faces, and two opposed leg portions extending lengthwise of and narrower than said grooves, said vertical passage connecting said central grooves, a pair of generally elongate rectangular rounded end vertical passage on each side of said intermediate double keyhole vertical passage extending from the top narrower grooves to the bottom face and a vertical recess in at least one end intermediate the side walls connecting said central grooves and having a cross section substantially equal to one half of said intermediate vertical passage and said blocks being laid up in staggered adjacent superimposed courses with the vertical passages in vertical alignment throughout the height of the wall and the horizontal grooves forming continuous horizontal passages intersecting the vertical passages throughout the length of the wall, metal reinforcing bars in at least a major portion of the intermediate double keyhole vertical passages and the passages formed by the horizontal mating intermediate grooves in the top and bottom faces and a network of solidified hydraulic cement grout filling said intermediate passages both horizontal and vertical and around the reinforcing bars.

11. A masonry wall structure as claimed in claim 10 wherein a pair of vertical passages on one side of the central vertical passage and a corresponding horizontal passage formed by the mating smaller top and bottom grooves contains one of a vertical and horizontal reinforcing bar and are filled with solidified hydraulic cement grout forming a continuous secondary network generally parallel to the said network formed in the intermediate passages.

* * * * *

UNITED STATES PATENT AND TRADEMARK OFFICE

CERTIFICATE OF CORRECTION

PATENT NO. : 4,319,440

DATED : March 16, 1982

INVENTOR(S) : JOHN N. RASSIAS and CECILY M. CLARK

It is certified that error appears in the above–identified patent and that said Letters Patent are hereby corrected as shown below:

Column 1, line 42, "partents" should be --patents--.

Column 2, line 13, there should be a period (.) after "materials".

Column 13, line 33, "monolithich" should be --monolithic--.

Column 13, line 36, "ilustrated" should be --illustrated--.

Signed and Sealed this

*Fifteenth* Day of *June 1982*

[SEAL]

*Attest:*

GERALD J. MOSSINGHOFF

*Attesting Officer*

*Commissioner of Patents and Trademarks*